US005203062A

United States Patent [19]

Nishio

[11] Patent Number: 5,203,062

[45] Date of Patent: Apr. 20, 1993

[54] INSERTION APPARATUS FOR PRESSING A RING INTO A PIPE

[75] Inventor: Kiyoshi Nishio, Osaka, Japan

[73] Assignee: Nippon Pillar Packing Co., Ltd., Osaka, Japan

[21] Appl. No.: 757,582

[22] Filed: Sep. 11, 1991

[51] Int. Cl.[5] ..... B23P 19/02

[52] U.S. Cl. ..... 29/237

[58] Field of Search ..... 29/237, 251, 235, 234; 285/247

[56] References Cited

U.S. PATENT DOCUMENTS

| | | | |
|---|---|---|---|
| 1,094,978 | 4/1914 | Church | 29/237 |
| 1,393,789 | 10/1921 | Kellenberger | 29/251 |
| 2,336,262 | 12/1943 | Krasberg | 29/251 |
| 3,157,112 | 11/1964 | Truhon | 29/251 |
| 4,785,517 | 11/1988 | Takano | 29/237 |

*Primary Examiner*—Robert C. Watson

*Attorney, Agent, or Firm*—Griffin Butler Whisenhunt & Kurtossy

[57] ABSTRACT

Apparatus (3) for pressing an inner ring (2) into a pipe (1) comprising a clamp base (8), a means (5) for pressing the inner ring along the axis of the pipe and a means for generating a force (6), all of them being located on the apparatus body wherein advancement of the pressing means permits an inner ring (2) held in the pressing means to be inserted into the end of a pipe which is held fixed in a clamp base (8). The pressing means has a ring holder (16) at its forward end for detachably holding the inner ring (2) to be inserted. The force generating means are supported by the apparatus body and comprise a pinion (21) engaged with a rack (5a).

4 Claims, 4 Drawing Sheets

INSERTION APPARATUS FOR PRESSING A RING INTO A PIPE

FIELD OF THE INVENTION

The present invention relates to apparatus for pressing an inner ring into a pipe for forming a bulge around the pipe which may be a resin pipe or the like.

PRIOR ART

There are many arrangements for forming a bulge in the end of a pipe section which is to be connected to another pipe section so that such a bulge prevents any of the connected pipe sections from slipping out of the joints between the pipe sections.

Although the prior art has proposed the formation of a bulge on a pipe in one operation, there is difficulty in forming the bulge in one operation, particularly if the pipe is made of a fluoresin, which is notoriously difficult to work.

In this regard, the prior art has proposed the formation of a bulge in a receiving pipe by pressing an inner ring, whose diameter is slightly larger than (i.e. bulges out beyond) the internal diameter of the receiving pipe, into the receiving pipe.

Apparatus for pressing an inner ring into a receiving pipe has already been proposed. But the large type has the drawbacks of being complicated and costly and further in being difficult to load and transport to a working site, while the small type cannot accurately press the inner ring into the receiving pipe without distortion during the insertion process. Furthermore, because the insertion process requires a large operating force, it thereby creates a burden to the operator of the apparatus.

SUMMARY OF THE INVENTION

It is a primary object of the invention to provide apparatus for pressing an inner ring into a receiving pipe which requires only one step to accurately perform the insertion work without distortion, which can be easily operated by one operator without imposing any extraordinary burdens upon the operator.

It is another object of the invention to provide apparatus for pressing an inner ring to be inserted into a receiving pipe which is easy to handle, inexpensive, and of a simplified and small structure.

It is another object of the invention to provide apparatus for pressing an inner ring into a receiving type which is adapted to handle a variety of insert ring and receiving pipe sizes.

The aforesaid objects are attained by apparatus for pressing an inner ring into a receiving pipe which includes an apparatus body on which is provided a clamp base for fixedly holding the receiving pipe. Means for pressing the inner ring along the axis of said receiving pipe is movably supported for both forward and backward motion by the apparatus body and has at one of its end a ring holder capable of holding the inner ring. The pressing means further comprise a rack which is moved forward or backward by a rotary pinion actuated by an operating lever.

To press the inner ring into the receiving pipe, the inner ring is held on a ring holder of the pressing means which moves the rack toward the receiving pipe, one end of which is fixedly held in the clamp base.

As the pinion is rotated to move the rack toward the receiving pipe a smoothly controlled advance of the inner ring into the receiving pipe can be achieved. After the inner ring has been completely inserted in the receiving pipe, the pinion rotation is reversed and the rack is gradually retracted, whereby the inner ring is detached from the retreating ring holder.

While it may be possible to achieve the insertion process by the use of a rotary screw mechanism, the rotary pinion and rack mechanism used in a preferred embodiment of the invention requires far smaller operating forces to be generated by the operator.

The foregoing and other objects, features and advantages of the invention will be apparent from the following more particular description of a preferred embodiment of the invention, as illustrated in the accompanying drawings.

DETAILED DESCRIPTION

Figure 1:
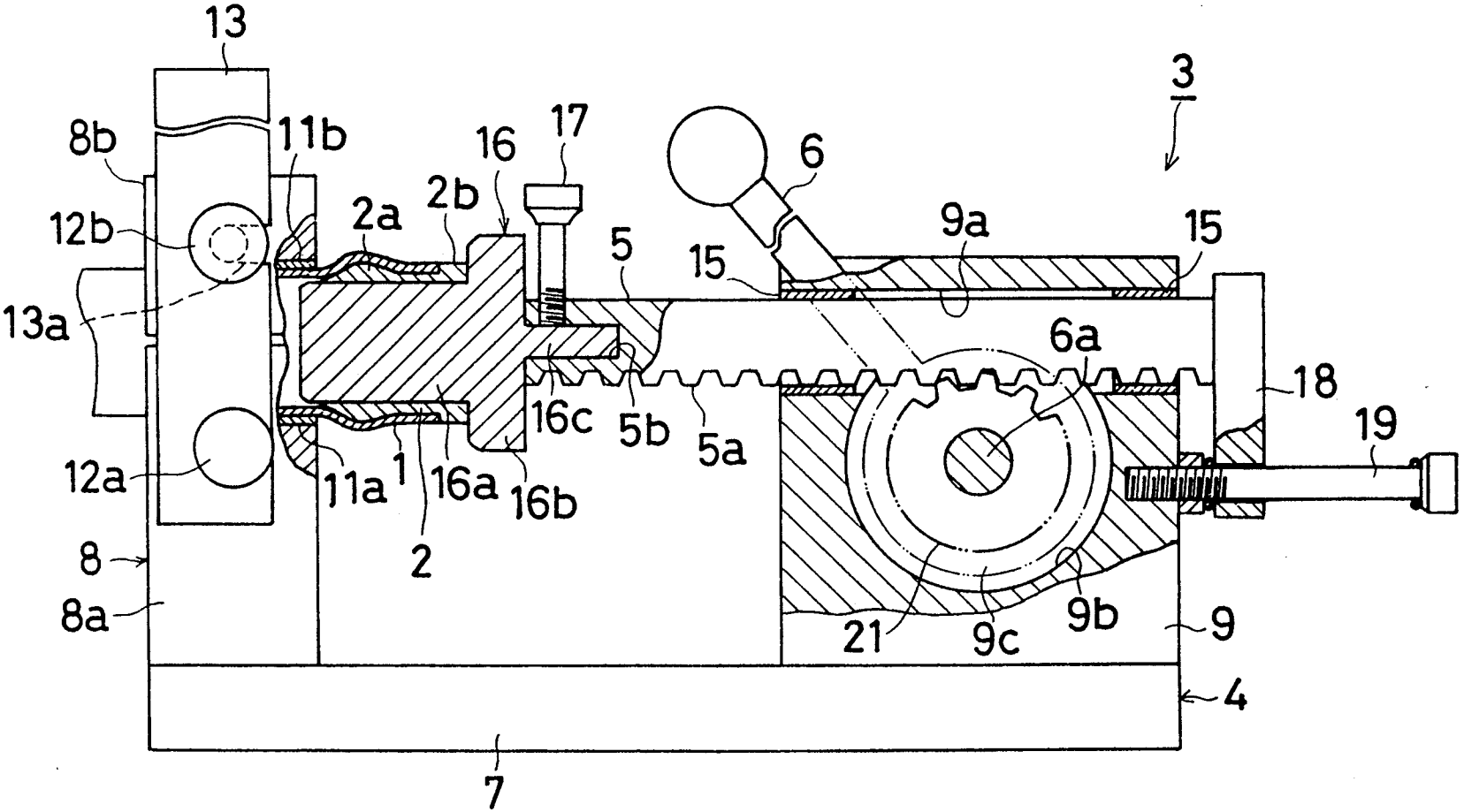
FIG. 1 is a partial longitudinal side view of the apparatus according to the invention after having completed the insertion of an inner ring into a receiving pipe.
Figure 2:
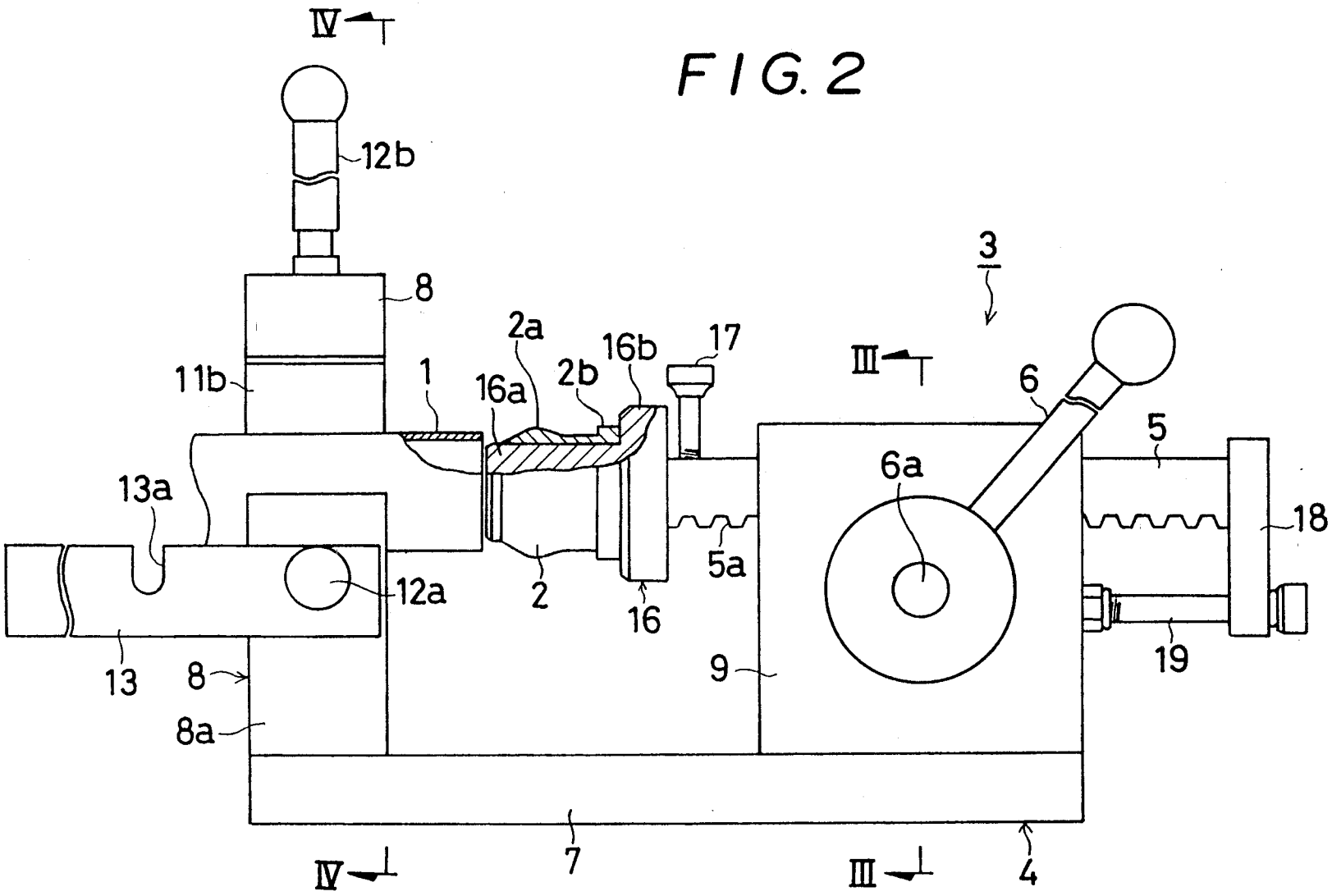
FIG. 2 is a side view of the apparatus of FIG. 1, illustrating the commencement of the insertion process.

Referring first to FIGS. 1 and 2, an inner ring 2, of ring-like shape, is to be inserted into the end of a receiving pipe 1, which may be a resin-made pipe. Inner ring 2 includes a portion 2*a* which bulges out to be slightly larger in diameter than the inner diameter of a receiving pipe 1 and also has an enlarged end part 2*b* which is adapted to engage the end of the receiving pipe 1 once the inner ring 2 has been inserted into pipe 1. Generally, the material for the inner ring 2 is selected to be the same as that for pipe 1. As shown in FIGS. 1–4, the apparatus 3 for pressing the inner ring 2 into receiving pipe 1 comprises the apparatus body 4, means 5 for pressing the inner ring 2 along the axis of the receiving pipe 1, and means 6 for generating the required force to insert the inner ring 2 into the receiving pipe 1.

The apparatus further includes a clamp base 8 and a gear box 9 both of which stand on the opposite ends respectively of base 7.

Figure 5:
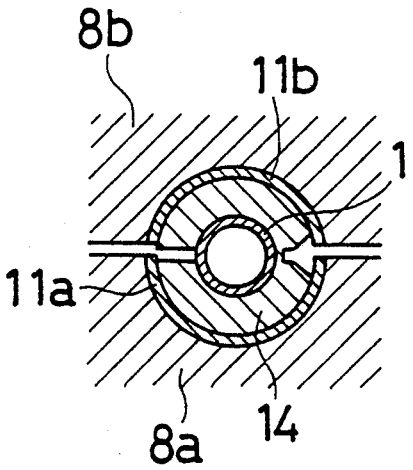

The clamp base 8 is constructed of a structure being divided into two portions, namely a fixed clamp part 8*a*, which is attached to base 7, and a movable clamp part 8*b*. The movable clamp part 8*b* is pivoted about a clamp pin 10 as a pivot point and is operated to be pivoted between a position of clamping the pipe 1 (as shown by the dotted lines in FIG. 4), where the movable clamp part 8*b* engages the fixed clamp part 8*a*, and a position of unclamping the pipe 1 (as shown by the solid line in FIG. 4) where the upper face of the fixed clamp 8*a* is pivoted to an open position. Semi-circular clamp grooves 8'*a* and 8'*b*, into which frictional pieces 11*a* and 11*b*, such as a rubber sheet or the like are inserted, are formed on the opposite faces of the clamp parts 8*a* and 8*b* respectively, so that the receiving pipe 1 to be clamped between the clamp parts 8*a* and 8*b* may be firmly clamped in a fixed position. Lever-like knobs 12*a* and 12*b* are provided to protrude from the clamp parts 8*a* and 8*b*, respectively, to cooperate with a locking lever 13 which is pivotably mounted on the base of knob 12*a*. When the locking lever is rotated about its pivot on knob 12*a* it will engage knob 12*b* by way of the groove 13*a*, if the movable clamp part 8*b* assumes the clamping position shown in the dotted lines in FIG. 4. If the diameter of pipe 1 is smaller than the clamp grooves 8'*a* and 8'*b*, as shown in FIG. 5, inserts 14, having a C-shaped section made of an elastic material such as urethane, are fitted to surround the receiving pipe 1 to be clamped, whereby the receiving pipe may be firmly clamped in the clamp base 8.

Figure 3:
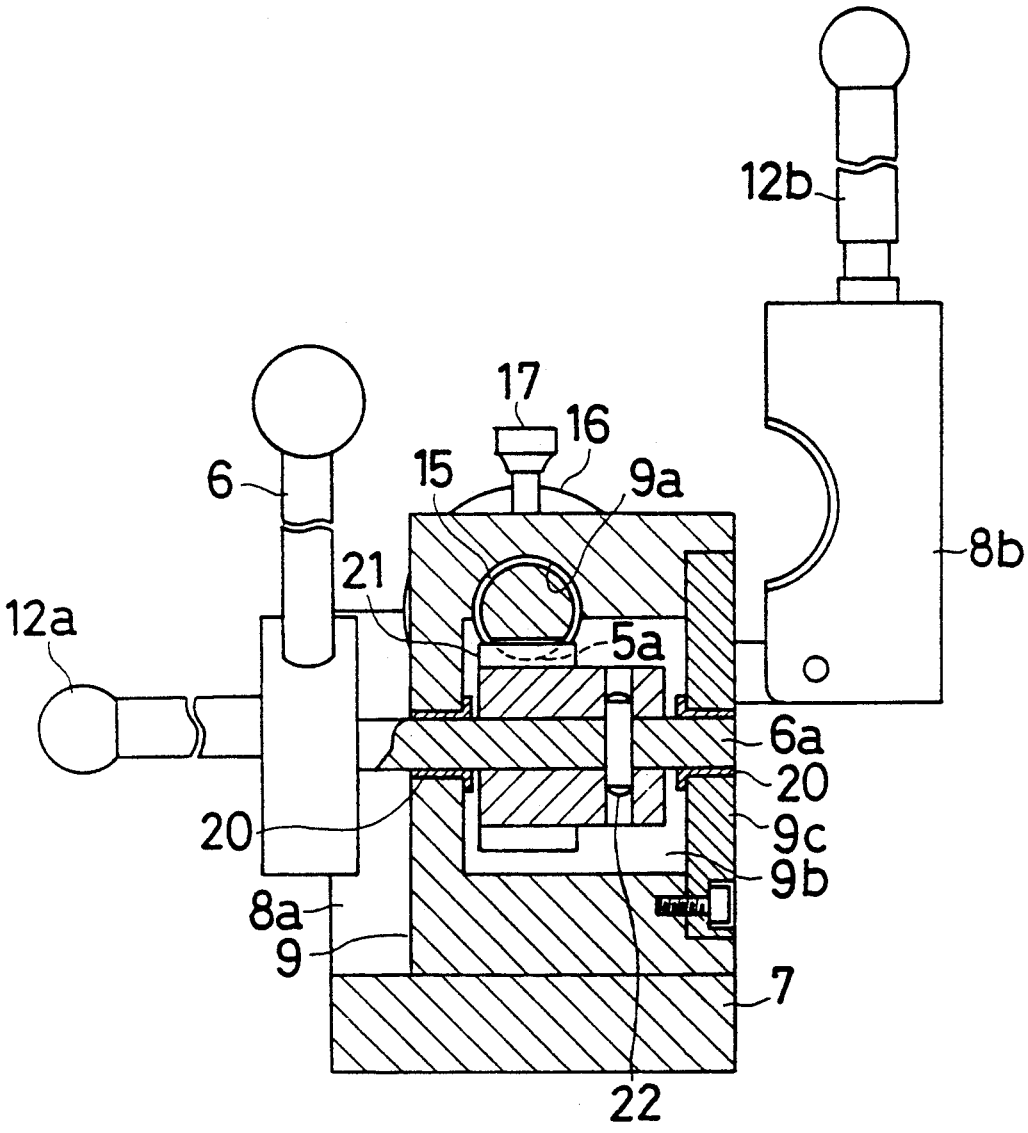
FIG. 3 is a longitudinal rear view taken along the line III—III of FIG. 2.
Figure 4:
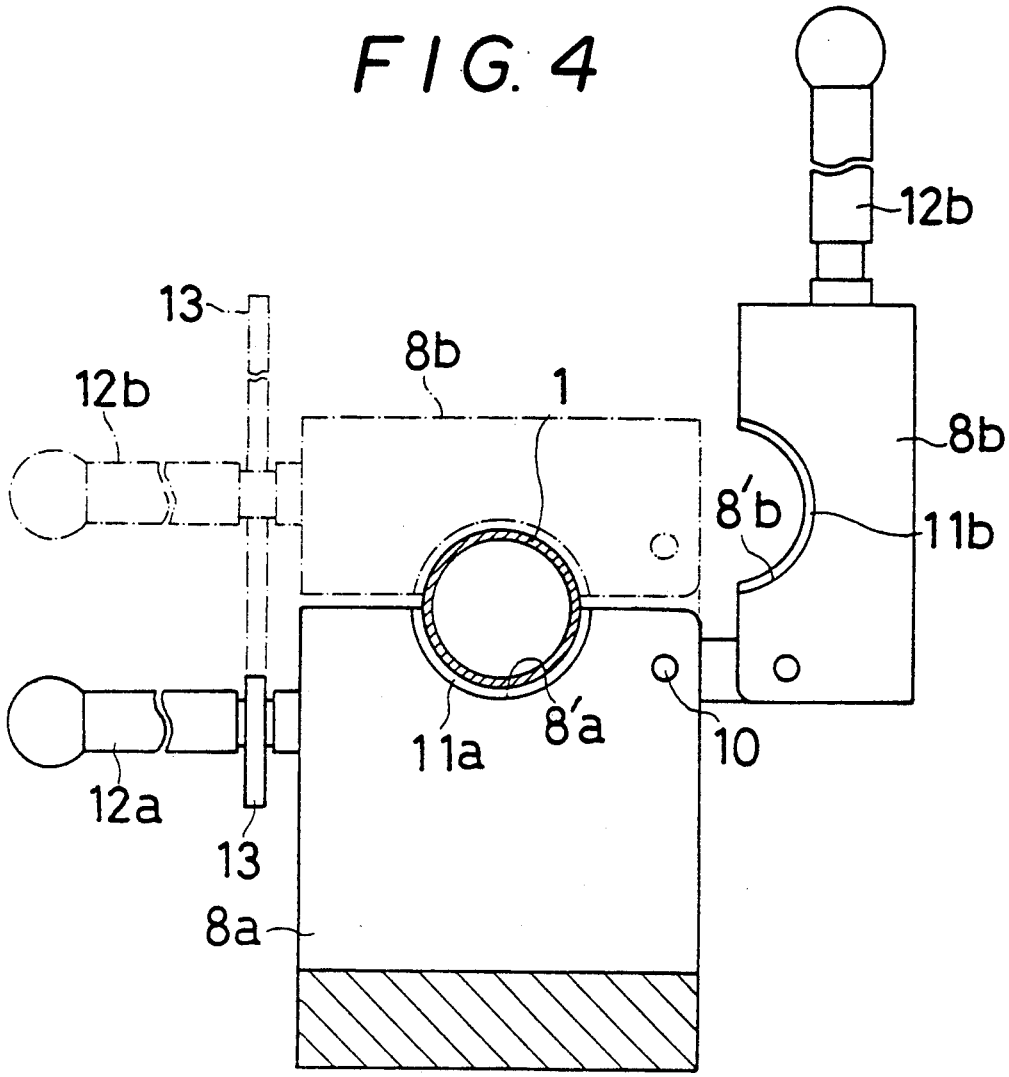
FIG. 4 is a longitudinal rear view taken along the line IV—IV of FIG. 2; and, FIG. 5 is a cross-sectional view illustrating the clamping of a pipe having a smaller diameter than the pipe shown in FIGS. 1–4.

Referring now to FIGS. 1 and 3, a bore 9*a*, and a space 9*b* containing a pinion 21, are all a part of a gear box 9. The space 9*b* containing the pinion 21 has an opening on one side face of the gear box 9 and such an opening is covered with a cover 9*c*.

Pressing means 5 for pressing the inner ring 2 is comprised of a shaft having its lower face equipped with a rack 5*a* extending through the bore 9*a* and is slidably movable therein and supported by the bearings 15.

The pressing means 5 has a ring holder 16 mounted at its front end. The ring holder 16 comprises an inner ring inserting part 16*a* and an elevated ledge 16*b* to engage with the enlarged end 2*b* of the inner ring 2, and a spindle 16*c* fit detachably into a mounting hole 5*b* on the front end of the pressing means 5. Ring holders 16 of varying dimensions may be thus mounted into the mounting hole 5*b* of the pressing means 5. Ring holder 16 is secured, or detached, by the use of a fixing screw 17.

A threaded bolt 19 protrudes from the rear of gearbox 9 through a guide plate 18 fixed to the rear end of the pressing means 5 and the stroke of the pressing means 5 may be adjusted by suitably rotating bolt 19 into, or out of, the gear box 9.

As shown in FIGS. 1-3, a pivot axle 6*a* is inserted into and supported in the wall of a gear box 9 and the lid 9*c* by way of the bearings 20. The pinion 21 is fixed to the pivot axle 6*a* by means of a pin 22 thus assuring that when axle 6*a* is rotated by rotating lever 6, pinion 21 will rotate and move the rack 5*a* backwards or forwards as desired.

In operation, a ring holder 16 having an inner ring 2 mounted thereon is advanced toward the end of receiving pipe 1 held in clamp base 8. As the rack 5*a* advances the ring holder 16 is pressed into the end of receiving pipe 1 (such a condition is shown in FIG. 1) and ring 2 is pressed into the receiving pipe 1.

After the enlarged end part 2*b* of the inner ring 2 engages the end face of receiving pipe 1, further rotation of lever 6 is stopped and the lever 6 is rotated in the reverse direction to withdraw ring holder 16 from the pipe.

While the invention has been described in conjunction with a specific embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. Apparatus for pressing with strong force an oversized inner ring into a receiving pipe having an internal diameter less than the largest diameter of said inner ring, comprising:

a clamp base for fixedly holding said pipe;

pressing means, comprising a ring holder adapted to hold said inner ring on one end thereof and including a rack, said rack extending horizontally and along the axis of said pipe and having downwardly extending teeth; and, a means for moving said rack, said means for moving said rack including a pinion to be engaged with said rack, so that said ring is inserted into said pipe when said rack is moved toward the end of said pipe, said pinion being mounted in an enclosed housing which supports two bearings in which said rack may slide.

2. Apparatus according to claim 1, wherein said ring holder is detachably mounted to said pressing means.

3. Apparatus according to claim 1, wherein said clamp base includes inserts in said clamp base so that said clamp base can securely clamp said pipe.

4. Apparatus for pressing an oversized inner ring into an open end of a long receiving pipe, said pipe having an internal diameter less than the largest diameter of said inner ring, said apparatus comprising:

a rack having downwardly extending teeth, said rack extending horizontally toward an open end of said pipe;

a pinion engaging said rack and rotatable in a first or a second direction to move said rack toward and away from said pipe;

an enclosed housing, said pinion being rotatably supported in said housing;

said housing supporting two slide bearings in which said rack may slide;

a ring holder mounted on said rack and having a ring inserting portion for receiving an inner ring, said ring holder extending toward the open end of said pipe and having a diameter less than the internal diameter of said pipe at least over the extent thereof which enters said open end of said pipe when said rack has been moved to a limit of travel toward said pipe.

* * * * *